US009797203B2

(12) United States Patent
Cao et al.

(10) Patent No.: US 9,797,203 B2
(45) Date of Patent: Oct. 24, 2017

(54) DEEPWATER DISCONNECTABLE TURRET SYSTEM WITH IMPROVED RISER CONFIGURATION

(71) Applicant: SINGLE BUOY MOORINGS INC., Marly (CH)

(72) Inventors: Peimin Cao, Sugar Land, TX (US); Philippe Lavagna, Monaco (MC)

(73) Assignee: SINGLE BUOY MOORINGS INC., Marly (CH)

( * ) Notice: Subject to any disclaimer, the term of this patent is extended or adjusted under 35 U.S.C. 154(b) by 15 days.

(21) Appl. No.: 14/889,048

(22) PCT Filed: Apr. 28, 2014

(86) PCT No.: PCT/EP2014/058558
§ 371 (c)(1),
(2) Date: Nov. 4, 2015

(87) PCT Pub. No.: WO2014/180687
PCT Pub. Date: Nov. 13, 2014

(65) Prior Publication Data

US 2016/0153247 A1 Jun. 2, 2016

(30) Foreign Application Priority Data

May 6, 2013 (EP) ..... 13166710

(51) Int. Cl.
*E21B 17/01* (2006.01)
*B63B 21/50* (2006.01)
(Continued)

(52) U.S. Cl.
CPC ..... *E21B 17/012* (2013.01); *B63B 21/508* (2013.01); *B63B 22/24* (2013.01); *E21B 17/015* (2013.01); *E21B 19/004* (2013.01)

(58) Field of Classification Search
CPC .... E21B 17/015; E21B 19/004; E21B 17/012; B63B 21/507; B63B 21/508; B63B 22/021
See application file for complete search history.

(56) References Cited

U.S. PATENT DOCUMENTS 4,371,037 A * 2/1983 Arnaudeau ..... B63B 22/021 114/230.15
5,860,840 A * 1/1999 Boatman ..... B63B 21/508 114/230.12

(Continued)

FOREIGN PATENT DOCUMENTS

| | | | |
|---|---|---|---|
| CA | 2 220 092 | A1 | 11/1996 |
| WO | 97/06341 | A1 | 2/1997 |
| WO | 2012/032163 | A1 | 3/2012 |

OTHER PUBLICATIONS

International Search Report, dated Aug. 29, 2014, from corresponding PCT application.

*Primary Examiner* — James G Sayre
(74) *Attorney, Agent, or Firm* — Young & Thompson

(57) ABSTRACT

A system for transporting hydrocarbons from reserves located under the sea floor to a turret connected to a hydrocarbon production vessel floating at the sea surface, the hydrocarbons being transferred through at least one rigid catenary riser extending from the sea floor to a buoy, the system for transporting hydrocarbons includes an upper section of the at least one substantially rigid riser directly attached to the buoy and provided with fairings, a middle section of the rigid riser is provided with buoyancy modules so to give it a lazy wave shape and a lower section of the substantially rigid riser is in contact with the seafloor at a distance X from the buoy vertical axis that is smaller than a distance Y between the buoy vertical axis and the mooring lines anchoring elements.

8 Claims, 3 Drawing Sheets

(51) Int. Cl.
*B63B 22/24* (2006.01)
*E21B 19/00* (2006.01)

(56) References Cited

U.S. PATENT DOCUMENTS

| | | | | |
|---|---|---|---|---|
| 5,927,224 | A * | 7/1999 | Etheridge | B63B 21/507 114/230.1 |
| 5,957,074 | A * | 9/1999 | de Baan | B63B 21/50 114/230.12 |
| 6,030,145 | A * | 2/2000 | Stewart, Jr. | E21B 17/015 405/171 |
| 6,220,787 | B1 | 4/2001 | Tanabe et al. | |
| 6,461,083 | B1 * | 10/2002 | Pionetti | E21B 17/015 166/350 |
| 2003/0170077 | A1 | 9/2003 | Herd et al. | |
| 2006/0021756 | A1 * | 2/2006 | Bhat | E21B 17/015 166/352 |
| 2008/0277123 | A1 * | 11/2008 | Baross | B63B 21/507 166/354 |
| 2009/0269141 | A1 | 10/2009 | Li et al. | |

* cited by examiner

DEEPWATER DISCONNECTABLE TURRET SYSTEM WITH IMPROVED RISER CONFIGURATION

FIELD OF THE INVENTION

The invention relates to a system for transporting hydrocarbons in large water-depths from reserves located under the sea floor to a turret that is rotatably connected to a hydrocarbon production vessel that is floating at the sea surface, the hydrocarbons being transferred through at least one substantially rigid catenary riser extending from the sea floor, the system for transporting hydrocarbons comprising three or more groups of mooring lines equally spaced apart, each group of mooring lines containing at least two individual mooring lines with polyester rope parts and which lower ends are attached to the seafloor with anchoring means; this groups of mooring lines having open sectors there-between in which the at least one substantially rigid catenary riser is located, the substantially rigid catenary riser and the grouped mooring lines are at the upper ends connected to and supported by one buoy that can be connected to and disconnected from the lower part of the turret; the upper part of the buoy being provided with a fluid connector that is in fluid connection with the upper end of the substantially rigid catenary riser connector, for attachment to the fluid transfer system of the turret and to allow transfer of hydrocarbons from the seabed to the production vessel, the buoy being provided with buoyancy means ensuring that when disconnected from the turret, the buoy with attached substantially rigid riser and grouped mooring lines floats below the wave active zone in the upper half part of the water-depth, preferably in the upper quarter part.

The invention also relates to a mooring line for a system for transporting hydrocarbons and to a riser for a system for transporting hydrocarbons.

BACKGROUND OF THE INVENTION

More and more offshore hydrocarbon fields are discovered in deepwater areas where there is little infrastructure and the Floating Production, Storage and Offloading (FPSO) concept can be economically competitive.

As part of concept of a FPSO for new deepwater fields, disconnectable FPSO options with focus on the vessel turret, the disconnectable system and potential riser solutions.

A typical field development which would comprise of 12 subsea wells in 6,200 ft of water, tied back to four subsea manifolds. The flow lines are for example assumed to be composed of two loops connecting to the FPSO facility via four risers.

The small amount of produced gas would be exported via a pipeline and export of the produced oil would be via shuttle tankers. The possible requirement for high pressure (and high volume) water injection was also part of the assumptions. The flow lines can be nominal 8" pipe designed to 7.5 ksi.

Although the field would have a mud-line shut-in pressure in excess of 10 ksi, it is assumed that the design pressure of flow lines and risers can be lowered by deployment of a high integrity pressure protection system (HIPPS).

On the other hand, the potential requirement for high pressure (and high volume) water injection is needed as well, i.e. the water injection riser would have to be designed for pressures exceeding 10 ksi. The subsea architecture can be composed of two loops (with two manifolds in each loop) connecting to the FPSO facility via four risers. The small amount of produced gas can be exported via a nominal 6" pipeline and export of the produced oil would be via shuttle tankers.

Prior to recent developments in deepwater mooring technology, the hybrid riser concept was the only solution available with disconnectable FPSOs. However, compared to SCRs or Lazy Wave SCRs, the hybrid riser concept has a more complex design, requires more hardware, requires heavy installation vessels, and is more CAPEX intensive.

In U.S. Pat. No. 5,957,074 there is shown a mooring and riser system for use with a turret moored hydrocarbon production vessel which comprises: three groups of mooring lines spaced approximately 120° apart, each group containing three individual mooring lines, the three groups of mooring lines having open sectors in-between and each being attached to the sea floor on a first end and attached to the hydrocarbon production turret on a second end; and a system to support the substantially rigid catenary riser located in the open sectors, to support the rigid catenary riser.

In the DOT 2011 paper "deepwater mooring and riser solutions for disconnectable FPSO's" published by the applicant, there is also disclosed disconnectable systems such as a Buoyant Turret Mooring (BTM) coupled with steel risers or an external turret system comprising a spar buoy which the FPSO is connected via an articulated yoke system hence decoupling the FPSO heave/pitch motions from the SCR friendly spar buoy. This type of external turret allows the steel risers and umbilicals to be in simple catenary configuration. The system comprising the BTM is provided with an internal turret FPSO supporting a disconnectable buoy (see FIG. 1). The buoy function is to support the mooring lines and risers/umbilicals upon disconnect, i.e. the buoy will slowly descend in the water column to an equilibrium condition (at least 50 m below the sea level) where there will be minimal wave kinematics.

The advantage of this concept is that all critical equipment (e.g. the swivel stack) is kept on the turret while the buoy is kept simple and its main functionality is to offer buoyancy in the disconnected scenario.

It is known to have Lazy Wave SCRs directly connected to an internal turret in a deepwater environmental (BC-10 FPSO).

A cost effective alternative is needed for hybrid risers, i.e. a turret and mooring system which would make the steel catenary riser (SCR) feasible, especially a BTM system coupled with Lazy Wave SCRs.

In connected scenarios, as the riser hang-off points move (heave, pitch and roll) with the vessel, the decoupling of the vessel motions from the riser touch down point (TDP) is achieved by utilizing distributed buoyancy in each riser and umbilical to create the "Lazy Wave" shape The system using lazy-wave SCR is more advantageous than the one using steel risers and umbilicals to be in simple catenary configuration as the riser payload on the BTM buoy when disconnected is reduced.

However, the available prior art does not mention how to ensure the integrity of the components of such systems especially after disconnection.

The system in the present invention proposes a particular disposition of the components in order to secure the integrity of the risers, umbilicals and mooring lines such that reconnection would be eased and safe with all elements in good conditions and not damaged.

The proposed system ensures that during disconnection is the relative heave motion between the buoy and the vessel and ensuring that there is no impact between the two floating bodies after the buoy separates from the turret.

Further as a quick connect and disconnect (QCDC) is provided and which can disconnect the buoy from the vessel in minutes, it is also an object of the present invention to ensure once again that even in emergency disconnection there is no damage and no impact between the risers, umbilicals and mooring lines.

SUMMARY OF THE INVENTION

The object of the present invention is to provide a system for transporting hydrocarbons in large water-depths from reserves located under the sea floor to a turret that is rotatably connected to a hydrocarbon production vessel that is floating at the sea surface, the hydrocarbons being transferred through at least one substantially rigid catenary riser extending from the sea floor, the system for transporting hydrocarbons comprising three or more groups of mooring lines equally spaced apart, each group of mooring lines containing at least two individual mooring lines with polyester rope parts and which lower ends are attached to the seafloor with anchoring means; this groups of mooring lines having open sectors there-between in which the at least one substantially rigid catenary riser is located, the substantially rigid catenary riser and the grouped mooring lines are at the upper ends connected to and supported by one buoy that can be connected to and disconnected from the lower part of the turret; the upper part of the buoy being provided with a fluid connector that is in fluid connection with the upper end of the substantially rigid catenary riser connector, for attachment to the fluid transfer system of the turret and to allow transfer of hydrocarbons from the seabed to the production vessel, the buoy being 3 provided with buoyancy means ensuring that when disconnected from the turret, the buoy with attached substantially rigid riser and grouped mooring lines floats below the wave active zone in the upper half part of the water-depth, preferably in the upper quarter part wherein an upper section of all the substantially rigid risers is directly attached to the buoy and provided with fairings, a middle section of the substantially rigid riser is provided with buoyancy modules so to give it a lazy wave shape and a lower section of all the substantially rigid riser is in contact with the seafloor at a radial distance X from the buoy vertical axis that is smaller than the radial distance Y between the buoy vertical axis and the mooring lines anchoring means. An advantage of the present invention is that the height of the lazy wave riser is between 80% and 100% of the radial distance X and the lazy wave risers and mooring system combined allows the vessel for a maximal offset of the vessel which is 8% of the water depth when the buoy is connected to the vessel.

The height of the lazy wave riser could also be between 100% and 300%, for instance 150%, of the radial distance X.

Furthermore, the lazy wave risers and mooring system combined may allow the vessel for a maximal offset of the vessel which is 6-10% of the water depth when the buoy is connected to the vessel.

A further advantage of the present invention is that the upper part of the lazy wave riser is provided with fairings to reduce drag forces from current loadings and from buoy descent velocity during disconnect and the lazy wave riser is provided in its lower part with VIV suppressing devices.

The fairings are typically used for three main reasons:

1. VIV suppression in currents for connected and disconnected modes, which is typical for steel riser systems in all floaters. Either strakes or fairings can be used, although strakes are most common since they are considered more robust.
2. Drag reduction due to deep currents in disconnected mode, which is essential, especially when the current profile is deep and the intensity is strong. The drag loads, mainly in horizontal direction, on the risers tends to offset the buoy and cause the buoy to set down when the mooring system is very soft in disconnected mode. One of the major reasons to use a foam buoy is because the strong current drags the buoy down to 200 m depth, which makes a steel buoy not economical.
3. Eliminate or mitigate riser compression or over stress during connected and disconnecting modes. Fairings are essential to reduce the drag loads, mainly in uplift direction, on the risers when the FPSO heaves down (connected mode) or when the buoy drops (disconnecting). The drag loads will cause riser compression or over-stress at upper catenary and sag bend region when the downward velocity from FPSO pitch and heave (connected mode) or buoy descent (disconnecting) exceeds a threshold limit, associated with "riser terminal velocity". One major design challenge to configure a disconnectable buoy and SLWR system is to balance the buoy descent velocity, fast enough to clear the FPSO and slow enough to avoid riser compression or overstress.

According to a preferred embodiment, the lazy wave riser at its upper end is provided with a steel stress joint and/or a flex joint.

According to a preferred embodiment, the lazy wave riser is covered with a thermal insulation layer for flow assurance of transferred hydrocarbons.

Another advantage of the present invention is that a lower part of the lazy wave riser is placed horizontally on the seafloor and can be at one end lifted off from the seafloor while the other end stays connected to the seafloor.

A further advantage of the present invention is that the lazy wave riser is made of steel, composite, thermoplastic material or combinations thereof.

According to a preferred embodiment, the lazy wave riser comprises pipe parts with the same inner diameter but with different characteristics and the fluid transfer system comprises at least one lazy wave production riser for transfer of hydrocarbons from a reserve to the vessel, at least one lazy wave riser for exporting the produced gas from the vessel via a subsea pipeline and at least one lazy wave riser for injection of water into a sub seafloor hydrocarbon reserve. Another advantage of the present invention is that the combined payload from the lazy wave risers is less than 1000 metric tons.

A further advantage of the present invention is that the mooring line comprises two chain parts at the end, a polyester part in between the chain parts and a spring buoy.

The middle section of the substantially rigid riser is preferably provided with buoyancy modules with strakes there-between.

BRIEF DESCRIPTION OF THE DRAWINGS

The invention will be further described below in connection with exemplary embodiments with reference to the accompanying drawings, wherein.

DESCRIPTION OF FIGURES

Figure 1:
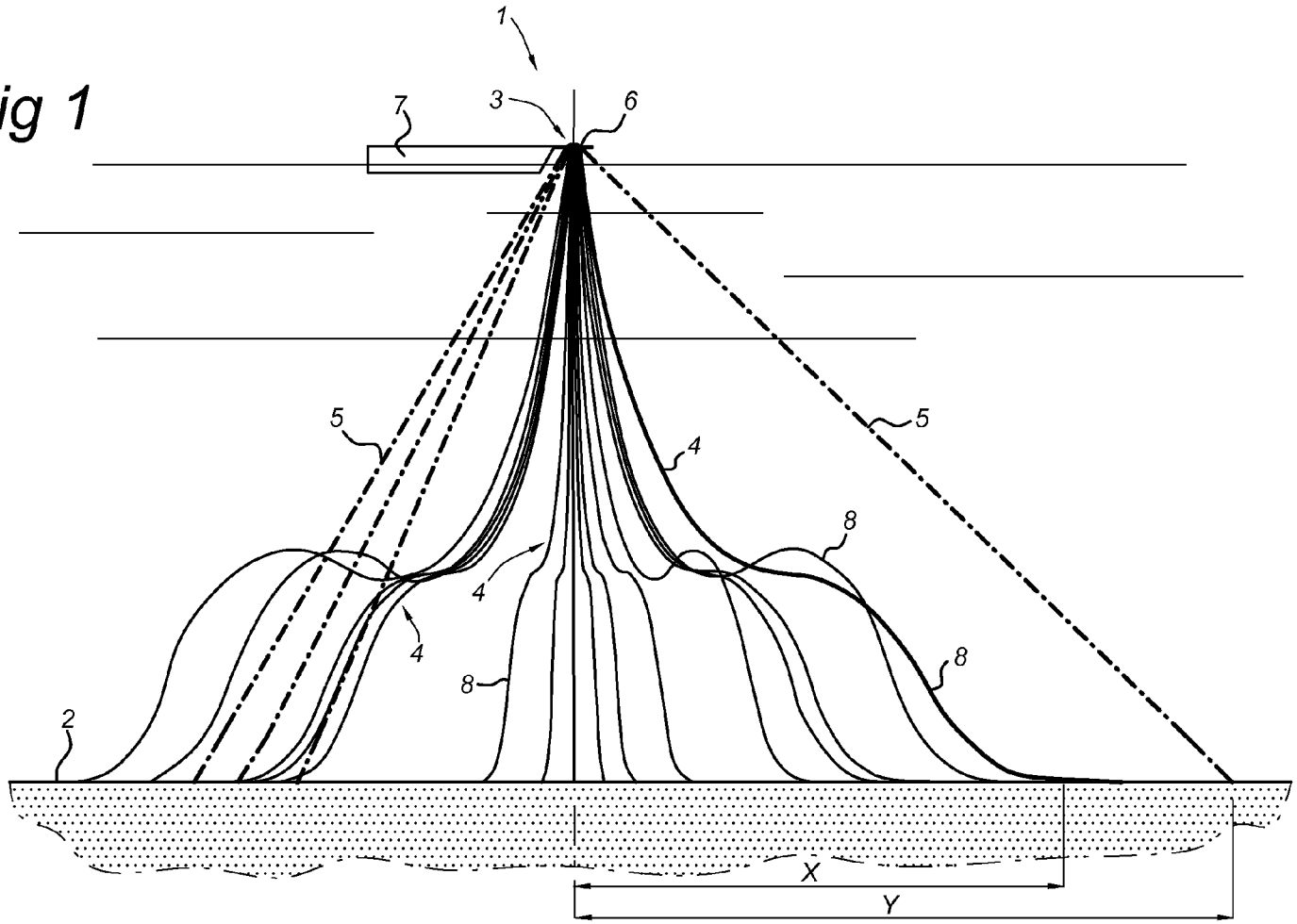
FIG. 1 shows an embodiment according to the present invention of an external turret connected to a BTM with lazy wave SCRs.

FIG. 1 shows an embodiment according to the present invention of an external turret connected to a BTM with lazy wave SCRs.

Figure 3:
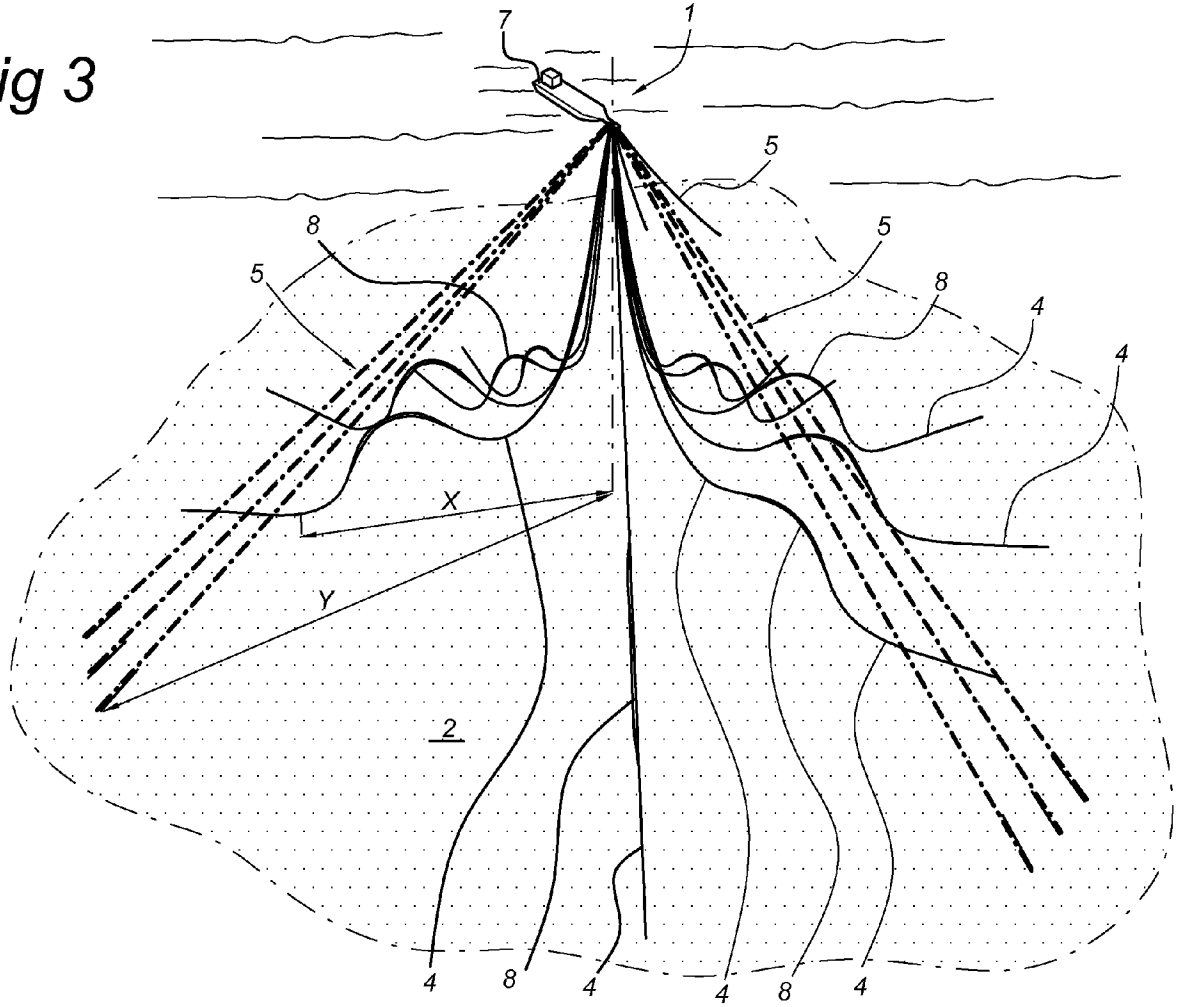
FIG. 3 shows the riser and umbilical system with FPSO and BTM mooring system with an internal turret.

In FIG. 1 there is shown a system 1 for transporting hydrocarbons in large water-depths. In the embodiment of FIG. 1, a production vessel 7 is moored to the seabed via an external turret 3 from which lower part a buoy 6 can be connected and disconnected. Groups of mooring lines 5 and risers 4, in a lazy wave configuration, are connected to the lower part of the buoy 6. As shown in FIG. 1 and FIG. 3, there is a radial distance between the buoy 6 vertical axis and the point where a riser 4 is in contact with the sea floor 2. As shown, the radial distance Y between the buoy 6 vertical axis and the mooring lines 5 anchoring means is bigger than the radial distance X.

Figure 2:
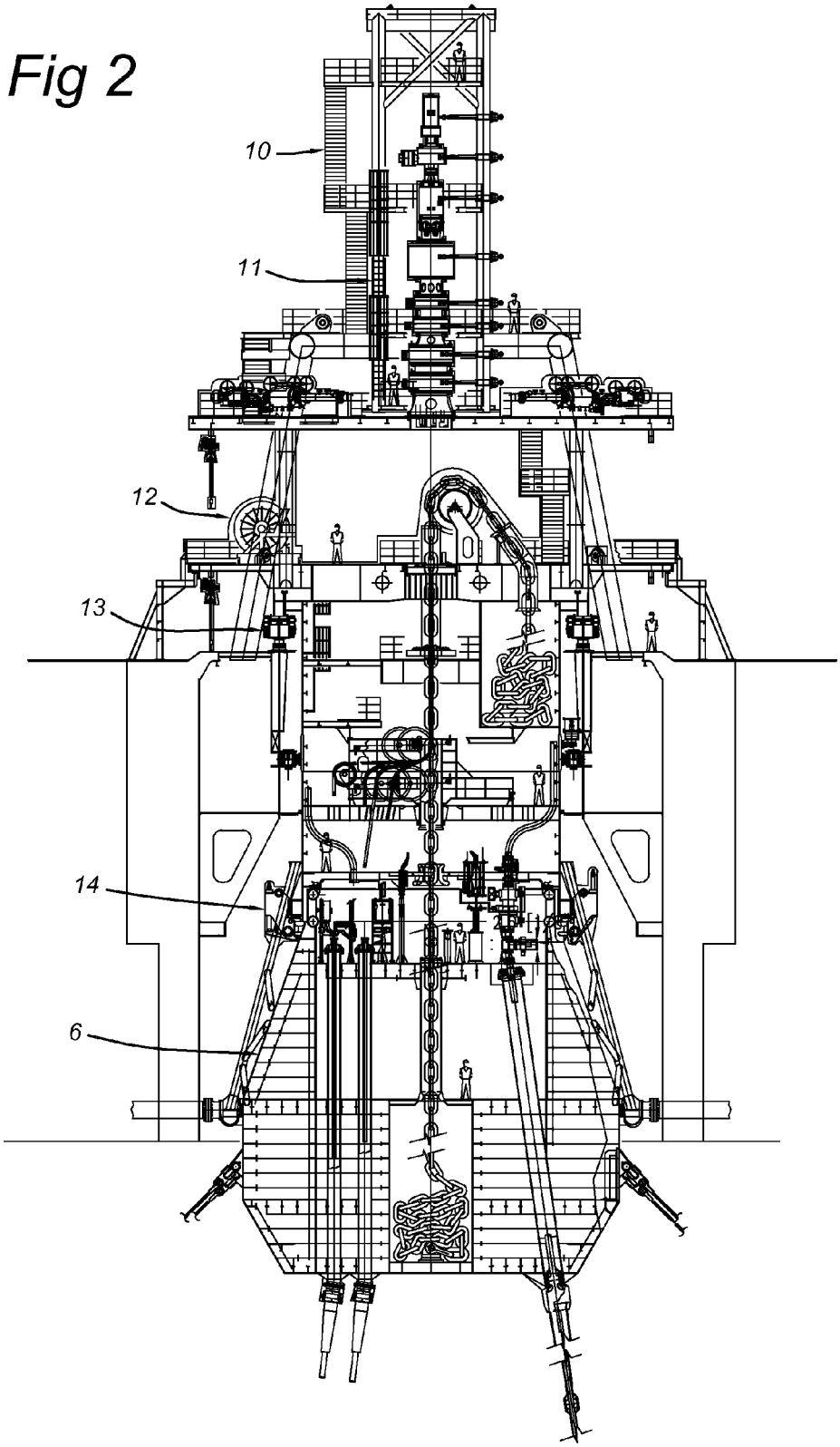
FIG. 2 shows a BTM buoy that is used to interface with an internal turret, according to another embodiment of the present invention.

FIG. 2 shows a BTM buoy that is used to interface with an internal turret, according to another embodiment of the present invention The BTM turret is shown in FIG. 2 and consists of the following components:

- A BTM buoy 6, interfacing with the internal turret 12 via a cage and a set of structural connectors.
- One or more structural connectors 14 between the buoy 6 and the vessel. It could be a central connector or several connectors that are distributed along the circumference on top of the BTM buoy 6.
- Connectors and retractors for the production fluid, export gas, and umbilical flow paths. These connectors are located on top the buoy.
- A structural bearing system 13 that transfers the turret payload to the vessel.
- The weathervaning system made of multiple bogeys
- A swivel stack 11 supported by a gantry structure 10.

The main limitation of the BTM concept in deepwater is related to the riser and mooring payload which drives the size of the BTM buoy, especially in deeper water. In order to limit the payload of risers, the solution is to keep the Lazy Wave location at a shallow depth below the sea level. In deeper waters, this approach leads to an increased demand for buoyancy (hence higher cost) and a much larger footprint of the riser system on the seabed. As for reducing the payload of mooring lines, the proposed solution is using polyester lines with spring buoys (about 40 tons of net buoyancy per mooring line in this case).

The I-tubes of the steel risers are inclined at the nominal riser departure angle to allow the riser pulling from the turret once the FPSO is on site and connected to the buoy. The I-tubes of the umbilicals are vertical since the flexible umbilicals can be pulled through their bend-stiffeners.

Each flow path, either those of risers or umbilicals, has a dedicated connector and retractor system on top of the buoy. The connected/retractor is rated for the design pressure of the fluid path and for the maximum depth of the BTM buoy when disconnected (about 120 m). The system can be disconnected in sea states up to Hs 8.8 m, and the disconnection can be carried in sea states up to at least Hs 2 m. The disconnection can be made without assistance from other vessels. More details of the turret and buoy including the flow line connectors/retractors.

FIG. 3 shows the riser and umbilical system with FPSO and BTM mooring system with an internal turret. In this embodiment, the BTM is comprised of an internal turret FPSO 7 supporting a disconnectable buoy 6. The buoy is designed to support the mooring lines 5 and risers/umbilicals 4 upon disconnect. Risers 4 have a lazy wave configuration by utilizing distributed buoyancy 8 in each riser and umbilical, hence decoupling the vessel motions from the riser touchdown point.

From this figure it also appears clearly that the radial distance X between the riser touchdown point and the buoy vertical axis is smaller than the radial distance Y between the buoy vertical axis and the mooring lines anchoring means.

Although particular embodiments of the invention have been described and illustrated herein, it is recognized that modifications and variations may readily occur to those skilled in the art, and consequently, it is intended that the claims be interpreted to cover such modifications and equivalents.

LIST OF REFERENCE NUMERALS

1. System for transporting
2. Sea floor
3. External turret
4. Riser
5. Anchoring means
6. Buoy
7. Production vessel
8. Distributed buoyancy modules
9. —
10. Overhead gantry structure
11. Swivel stack
12. Turret structure
13. Bearing system
14. Structural connector X=radial distance between the riser touchdown point and the buoy vertical axis Y=between the buoy vertical axis and the mooring lines anchoring means

The invention claimed is:

1. A system (1) for transporting hydrocarbons from reserves located under the sea floor (2) to a turret (3) that is rotatably connected to a hydrocarbon production vessel that is floating at the sea surface, comprising at least one substantially rigid catenary riser (4) extending from the sea floor (2) for transport of said hydrocarbons to the turret, said system comprising:

three or more groups of mooring lines equally spaced apart, each group of mooring lines containing at least two individual mooring lines with polyester rope parts, the mooring lines each comprising two chain parts at the end, a polyester part between the chain parts and a spring buoy, wherein the lower ends of the mooring lines are anchored to the sea floor, said groups of mooring lines having open sectors therebetween in which the at least one substantially rigid catenary riser (4) is located, wherein the substantially rigid catenary riser (4) and the grouped mooring lines have upper ends connected to and supported by one buoy (6) which is adapted to be connected to and disconnected from the lower part of the turret (3), wherein said buoy, when connected to the turret, is partially accommodated within the turret and held in position with respect to the turret by one or more structural connectors (14), the upper part of the buoy being provided with a fluid connector that is in fluid connection with the upper end of the substantially rigid catenary riser (4) connector, for attachment to the fluid transfer system of the turret (3) to allow said transfer of hydrocarbons from the seabed to the production vessel, the buoy having a buoyancy such that when disconnected from the turret (3), the buoy with attached substantially rigid riser (4) and grouped mooring lines floats below the wave active zone in the upper half part of the water-depth, wherein, groups of the substantially rigid risers are connected to the lower part of the buoy (6), an upper section of each of the substantially rigid risers (4) is directly attached to the buoy, a middle section of each substantially rigid riser (4) is provided with buoyancy modules (8) so to give each substantially rigid riser (4) a lazy wave shape, and a lower section of each of the substantially rigid risers (4) is in contact with the sea floor at a radial distance X from the buoy vertical axis that is smaller than the radial distance Y between the buoy vertical axis and the location wherein the lower ends of the mooring lines are anchored to the sea floor, and the lazy wave shape of the substantially rigid riser is located below sea level.

2. The system for transporting hydrocarbons according to claim 1, wherein the height of the lazy wave riser (4) is between 80% and 100% of the radial distance X.

3. The system for transporting hydrocarbons according to claim 1, wherein a lower part of the lazy wave riser (4) is placed horizontally on the sea floor and can be at one end lifted off from the sea floor while the other end stays connected to the sea floor.

4. The system for transporting hydrocarbons according to claim 1, wherein the fluid transfer system comprises at least one lazy wave production riser (4) for transfer of hydrocarbons from a reserve to the vessel, at least one lazy wave riser (4) for exporting the produced gas from the vessel via a subsea pipeline and at least one lazy wave riser (4) for injection of water into a sub sea floor hydrocarbon reserve.

5. The system for transporting hydrocarbons according to claim 1, wherein the departure angle at the buoy of the mooring line is less than 60 degrees, preferably less than 45 degrees, more preferably less than 30 degrees with the vertical when the buoy is connected to the vessel.

6. The system for transporting hydrocarbons according to claim 1, wherein the buoy with attached substantially rigid riser (4) and grouped mooring lines floats below the wave active zone in the upper quarter part of the water-depth.

7. The system for transporting hydrocarbons according to claim 1, wherein the height of the lazy wave riser (4) is between 100% and 300% of the radial distance X.

8. The system for transporting hydrocarbons according to claim 1, wherein, with the buoy connected to the vessel, the lazy wave risers (4) and mooring system combined allow the vessel a maximal offset of 8% of the water depth.

* * * * *